US009841167B2

(12) United States Patent
Benner et al.

(10) Patent No.: US 9,841,167 B2
(45) Date of Patent: Dec. 12, 2017

(54) LIGHTING SYSTEM WITH ACTIVELY CONTROLLABLE OPTICS AND METHOD

(71) Applicant: GE LIGHTING SOLUTIONS, LLC, East Cleveland, OH (US)

(72) Inventors: Kevin Jeffrey Benner, Solon, OH (US); Josip Brnada, Willoughby, OH (US); Dengke Cai, Mentor, OH (US); Thomas Clynne, East Cleveland, OH (US); Raghu Ramaiah, Mentor, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 36 days.

(21) Appl. No.: 14/850,596

(22) Filed: Sep. 10, 2015

(65) Prior Publication Data

US 2016/0252235 A1 Sep. 1, 2016

Related U.S. Application Data

(60) Provisional application No. 62/055,323, filed on Sep. 25, 2014.

(51) Int. Cl.

| | |
|---|---|
| ***F21V 14/00*** | (2006.01) |
| ***F21V 7/04*** | (2006.01) |
| ***F21V 23/04*** | (2006.01) |
| *F21V 3/00* | (2015.01) |
| *F21W 131/103* | (2006.01) |
| *F21K 9/233* | (2016.01) |
| *F21Y 115/10* | (2016.01) |

(52) U.S. Cl.
CPC ..... *F21V 14/003* (2013.01); *F21V 23/0435* (2013.01); *F21K 9/233* (2016.08); *F21V 3/00* (2013.01); *F21V 7/041* (2013.01); *F21W 2131/103* (2013.01); *F21Y 2115/10* (2016.08)

(58) Field of Classification Search
CPC ..... F21V 14/003; F21Y 2101/02
See application file for complete search history.

(56) References Cited

U.S. PATENT DOCUMENTS

| | | | |
|---|---|---|---|
| 5,335,101 | A | 8/1994 | Reamey |
| 5,424,927 | A | 6/1995 | Schaller et al. |
| 5,593,615 | A | 1/1997 | Nerad et al. |
| 5,641,426 | A | 6/1997 | Nerad et al. |
| 5,831,698 | A | 11/1998 | Depp et al. |
| 5,867,238 | A | 2/1999 | Miller et al. |
| 6,829,071 | B2 | 12/2004 | Allen et al. |
| 7,564,070 | B2 | 7/2009 | Sayers et al. |

(Continued)

FOREIGN PATENT DOCUMENTS

| | | | |
|---|---|---|---|
| EP | 2256525 | B1 | 12/2010 |
| JP | H05159613 | A | 6/1993 |

(Continued)

*Primary Examiner* — Elmito Breval
(74) *Attorney, Agent, or Firm* — Peter T. DiMauro; GE Global Patent Operation

(57) ABSTRACT

A lighting system and method electrically control optics of light generated by a light source. The light source generates a light defined by a light distribution. An electro-active optical component changes the light distribution responsive to a change in an electric potential applied across the electro-active optical component by an electronic control system.

16 Claims, 15 Drawing Sheets

(56) References Cited

U.S. PATENT DOCUMENTS

| | | | | |
|---|---|---|---|---|
| 7,633,581 | B2 | 12/2009 | Sikharulidze | |
| 8,427,605 | B2 | 4/2013 | Boonekamp et al. | |
| 8,432,500 | B2 | 4/2013 | Van Bommel et al. | |
| 8,750,671 | B1 | 6/2014 | Kelly et al. | |
| 2008/0186709 | A1 | 8/2008 | Kuiper et al. | |
| 2008/0205075 | A1 | 8/2008 | Hikmet et al. | |
| 2012/0162964 | A1 | 6/2012 | Hikmet et al. | |
| 2012/0169953 | A1* | 7/2012 | Kataoka | F21S 8/04 349/36 |

FOREIGN PATENT DOCUMENTS

| | | | | |
|---|---|---|---|---|
| JP | 05210077 | A | * | 8/1993 |
| WO | 2007069125 | A2 | | 6/2007 |
| WO | 2007080543 | A1 | | 7/2007 |
| WO | 2012011936 | A1 | | 1/2012 |
| WO | 2013083647 | A1 | | 6/2013 |

* cited by examiner

LIGHTING SYSTEM WITH ACTIVELY CONTROLLABLE OPTICS AND METHOD

CROSS-REFERENCE TO RELATED APPLICATIONS

This application claims priority to U.S. Provisional Application No. 62/055,323, which was filed on 25 Sep. 2014, and the entire disclosure of which is incorporated herein by reference.

FIELD

Embodiments of the subject matter disclosed herein relate to lighting systems.

BACKGROUND

Different types of lighting systems include light sources that generate light. The light can be emitted by the lighting systems in a wide variety of shapes and/or directions. In some systems, filters are used to change the appearance or direction in which the light is oriented. For example, optic lenses may be fixed onto lighting systems between the light source and one or more targets or observers of the light. These fixed lenses can refract the light to change the direction and/or appearance of the light. The lenses, however, may not be able to be moved relative to the light source without manually removing or altering the lenses, or without some mechanical system that moves the light source relative to the lens or moves the lens. As a result, the direction and/or appearance of the light emitted by the lighting systems may be fixed without manual intervention with the lighting system or mechanical actuation of the system, both of which add to the complexity and/or cost of lighting systems.

Other types of lighting systems can include lenses or surfaces that change appearance in order to block some or all of the light emitted by a light source. For example, some windows and/or glass doors may include materials that become cloudy or otherwise change appearance to block the transmission of one or more, or all, wavelengths of light from passing through the window and/or door for security or privacy purposes. Some automobiles include windows that may change a tinting color to block one or more wavelengths of light from passing through the window. These types of systems, however, can reduce the amount of energy of the light that passes through between the source of the light and one or more targets or observers of light. As a result, these types of systems may be undesirable for lighting systems that are used to illuminate a room or other area.

BRIEF DESCRIPTION

In one embodiment, a method (e.g., for actively controlling optics of a lighting system) includes generating light comprising a light distribution from a light source and changing the light distribution by changing an electric potential applied across an electro-active optical component by an electronic control system.

In another embodiment, a system (e.g., a lighting system) includes a light source and an electro-active optical component. The light source is configured to generate a light defined by a light distribution. The electro-active optical component is configured to change the light distribution responsive to a change in an electric potential applied to the electro-active optical component.

In another embodiment, another system (e.g., a lighting system) includes a light source and an electro-active optical component. The light source is configured to generate a light defined by a light distribution. The electro-active optical component is configured to change the light distribution responsive to a change in an electric potential applied to the electro-active optical component. The electro-active optical component also is configured to change a direction at which the light distribution is oriented responsive to a change in specularity of the electro-active optical component.

BRIEF DESCRIPTION OF THE DRAWINGS

The subject matter described herein will be better understood from reading the following description of non-limiting embodiments, with reference to the attached drawings, wherein below.

DETAILED DESCRIPTION

Embodiments of inventive subject matter described herein provide for lighting systems and methods that include or use a light source generating light defined by a light distribution. The light distribution can represent a direction in which the light generated by light source is oriented, a shape or throw of the light, or an intensity of the light. One or more optical assemblies, such as diffusing assemblies and/or reflective assemblies, are electrically controlled to change the distribution of the light. These assemblies may apply electric potential between or across conductive layers on opposite sides of a liquid crystal layer. Depending on the application, removal, and/or magnitude of the electric potential, the assemblies may scatter the light by different amounts to change the light distribution. In one aspect, a reflective assembly can include a reflective layer on one side of the liquid crystal layer and a light transmissive and conductive layer on the opposite side of the liquid crystal layer. Application or removal of electric potential and/or the magnitude of electric potential that is applied across the reflective layer and the other conductive layer can change the specularity of the reflecting assembly. The change in specularity also can change the distribution of the light.

The embodiments described herein may change the distribution of the light without blocking one or more wavelengths of the light that is generated in one embodiment. For example, instead of filtering or blocking one or more wavelengths of the light from passing through or propagating through the assemblies, one embodiment of the subject matter described herein may not block or reduce energy of the light propagating through the assemblies by more than a designated amount (for example, may not reduce the energy of the light by more than 10%, 15%, 20%, or the like).

Figure 1:
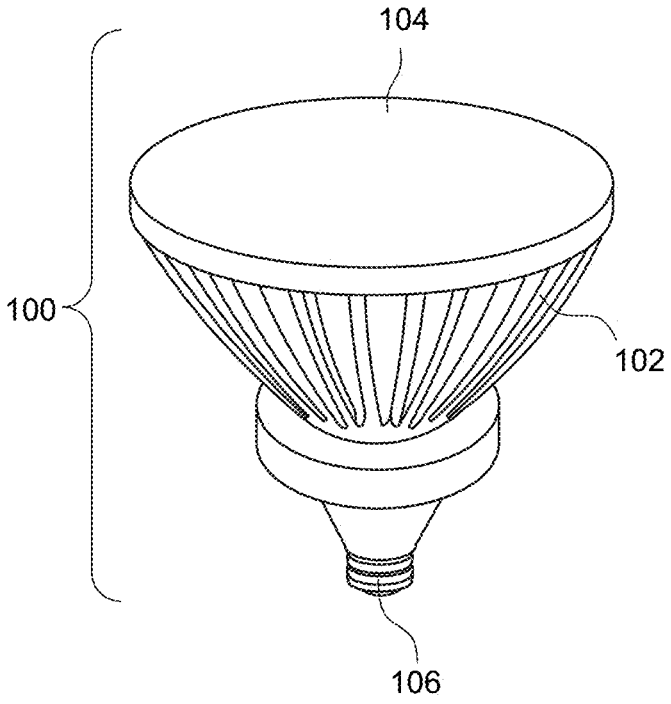
FIG. 1 illustrates a perspective view of a lighting system according to one embodiment.

FIG. 1 illustrates a perspective view of a lighting system 100 according to one embodiment. The lighting system includes an external or outer housing 102 with a light source (not shown in FIG. 1) disposed therein. A lens 104 may be coupled with the housing 102 with light generated by the light source inside the housing 102 propagating through the lens 104 and on to one or more targets or observers of the lighting system 100. For example, light generated by the light source may propagate through the lens 104 and out of the lighting system 100 on to floors, walls, ceiling, or other objects around. Alternatively, the lens 104 is not included in the lighting system 100. An electrical connector 106 is operably connected with the light source in order to connect the light source with a power supply (not shown in FIG. 1) to power the light source. As described herein, the connector 106 also may supply electric current from the power supply to one or more of the optical assemblies described herein. While the lighting system 100 is shown as a floodlight, alternatively, the lighting system 100 may represent another type of light, such as a light bulb, a lamp, a directional lamp, a tube, a troffer, a light fixture (for example, a streetlight) or the like.

Figure 2:
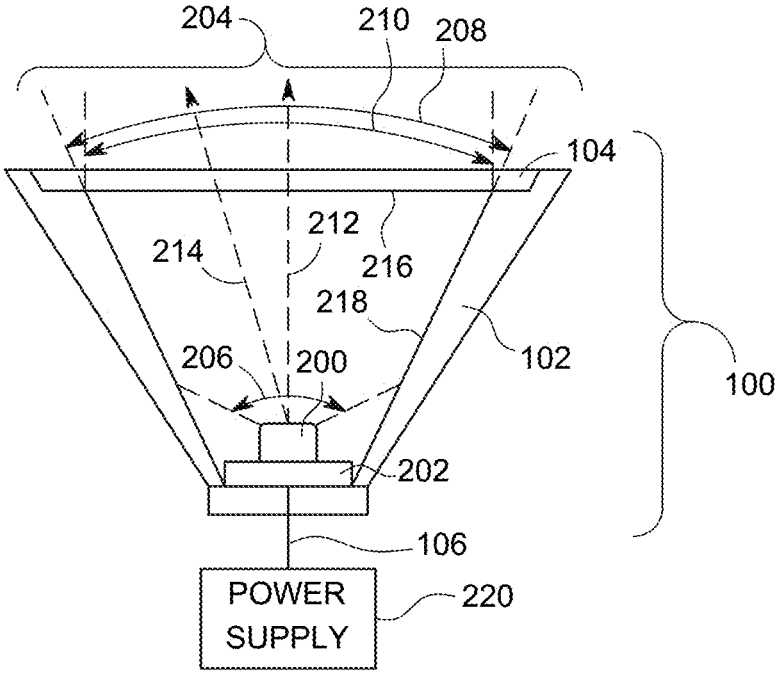
FIG. 2 illustrates another view of the lighting system shown in FIG. 1 according to one embodiment.

FIG. 2 illustrates another view of the lighting system 100 shown in FIG. 1 according to one embodiment. The lighting system 100 includes the light source 200 disposed within the housing 102 of the lighting system 100. The light source may represent one or more devices that generate light, such as one or more light emitting devices (LEDs). The connector 106 connects a power supply circuit 202 of the lighting system 100 with the power supply 220. The power supply circuit 202 can include or be embodied in a printed circuit board or other type of device that conducts electric current from the power supply 220 to the power source 200 via the connector 106. The power supply 220 can represent a source of electric current, such as an outlet, a utility grid, a battery, or the like. The power supply 220 may be internal to the lighting system 100 (such as when the power source 220 is included within or connected with the housing 102) or may be external to the lighting system 100.

The lighting system 100 may include one or more optical assemblies, such as one or more diffusing assemblies 216 and/or one or more reflective assemblies 218. In the illustrated embodiment, the lighting system 100 includes a single diffusing assembly 216 and a single reflective assembly 218. Alternatively, the lighting system 100 may include multiple assemblies 216, multiple assemblies 218, no assembly 216, and/or no assembly 218.

The diffusing assembly 216 may be in the shape of a substantially planar disk (e.g., a circular or other shape of the disk with the outer dimensions of the diffusing assembly 216 being larger in two directions in a common plane than in a direction that is orthogonal to the plane). The reflective assembly 218 may have a frustoconical shape around the light source 200. Alternatively, a different number, arrangement, and/or shape of the diffusing assembly 216 and/or reflective a summary 218 may be provided.

In operation, the light source 200 generates light having a light distribution 204. The light distribution 204 can be defined by a shape and/or direction 212 in which the light propagates from the lighting system 100. The direction of the light can represent an optical axis of the light that indicates a center of the distribution of light emitted by the light source 200. Alternatively, the direction of the light distribution represents an axis about which the distribution of the light is symmetric. The shape of the light can represent a throw or an emitted volume or angle of the light. The throw of the light can represent the angles at which the intensity of the emitted light is at least 50% of the maximum intensity of the emitted light.

The diffusing assembly 216 and/or reflective assembly 218 may be electrically controlled in order to change the distribution 204 of the light without moving the light source 200 or any other component of the lighting assembly 100. The light generated by the light source 200 may initially be generated by the light source 200 to the shape defined by a throw angle 206 shown in FIG. 2. The light emanating from the lighting system 100 may have a distribution with a shape defined by a throw angle 208 or 210. The throw angles 206, 208, 210 represent the spread of the light, and can represent volumes that include at least 50% of the maximum intensity of the light.

The light may propagate from the light source 200 to the diffusing assembly 216. The diffusing assembly 216 may electrically change scattering of the light as the light propagates through the diffusing assembly 216, as described below. This scattering can change the distribution of the light, such as by reducing or increasing the throw angle 208, 210 of the light. For example, electrically controlling the diffusing assembly 216 to reduce the amount of scattering of the light as the light passes through the diffusing assembly 216 can cause the distribution of the light to have a throw angle 210. Electrically controlling the diffusing assembly 216 to increase the scattering of the light as the light passes through the diffusing assembly 216 can cause the distribution of the light to have a larger throw angle 208.

The reflective assembly 218 may be electrically controlled in order to change the direction of the light. The light may be initially generated by the light source 202 and propagate along a direction 212. The specularity of the reflective assembly 218 can be electrically controlled to vary the amount of scattering of the light as the light passes through one or more layers of the reflective assembly 218 prior to and/or after reflecting off of a reflective surface in the reflective assembly 218. Changes in the amount of scattering of the light within the reflective assembly 218 can change the specularity of the reflective assembly 218 and, as a result, alter the direction of the light.

Figure 3:
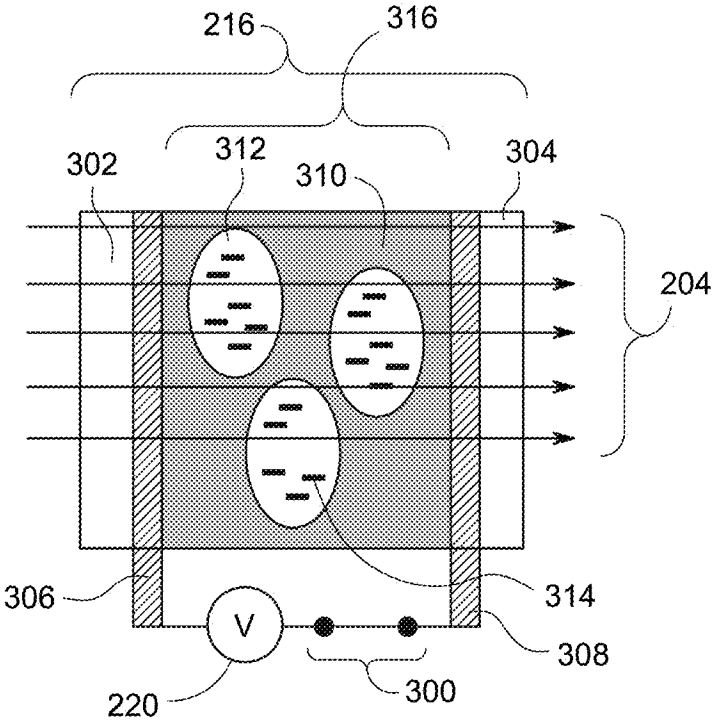
FIG. 3 illustrates operation of a cross-sectional view of a diffusing assembly shown in FIG. 2 according to one embodiment.

FIG. 3 illustrates operation of a cross-sectional view of the diffusing assembly 216 shown in FIG. 2 according to one embodiment. The diffusing assembly 216 includes a diffusing layer 316 that controls how much light is scattered during passage of the light through the diffusing assembly 216. In one embodiment, the diffusing layer 316 includes a liquid crystal layer. The diffusing assembly 316 can include a polymer matrix 310 having liquid crystals 312 with liquid crystal molecules 314 disposed therein. The diffusing layer 316 is disposed between opposite conductive and light transmissive layers 306, 308.

The layers 306, 308 may be conductive and also may permit light generated by the light source 200 shown in FIG. 2 to propagate through the layers 306, 308. One example of such layers 306, 308 includes indium tin oxide (ITO) layers. Other types of transmissive and conductive materials, such as other metal oxides or graphene, may be employed as materials for the layers 306, 308. In the illustrated embodiment, outer dielectric layers 302, 304 are disposed outside of the conductive and light transmissive layers 306, 308. The layers 302, 308 can be formed from one or more light transmissive dielectric materials, such as polyethylene terephthalate (PET).

The conductive and light transmissive layers 306, 308 may be conductively coupled with the power source 220, such as by the power supply circuit 202 shown in FIG. 2. The power supply circuit 202 can include one or more switching devices 300, such as switches, relays, etc., which can close to supply electric current to the conductive and light transmissive layers 306, 308. This current can apply an electric potential across or between the layers 306, 308 such that one layer 306 or 308 is at a higher potential or voltage than the other layer 308 or 306.

Figure 4:
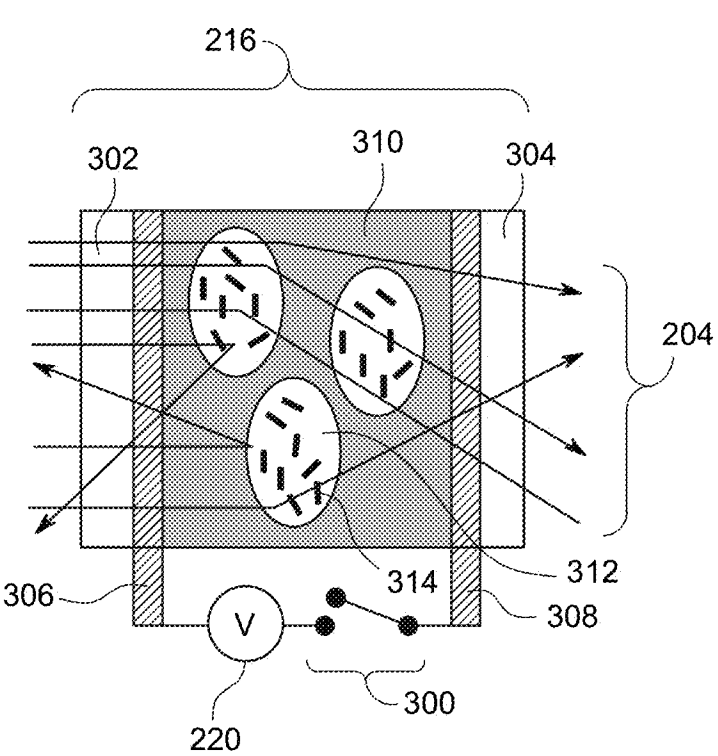
FIG. 4 illustrates operation of the cross-sectional view of the diffusing assembly shown in FIG. 2 according to one embodiment.

FIG. 4 illustrates operation of the cross-sectional view of the diffusing assembly 216 shown in FIG. 2 according to one embodiment. FIG. 4 represents how the diffusing layer 316 behaves when no electric potential is applied across or between the conductive and light transmissive layers 306, 308 (or, when electric potential is applied, but the potential is less than a designated switching voltage of the layer 316). FIG. 3 represents how the diffusing layer 316 behaves when the electric potential is applied across or between the conductive and light transmissive layers 306, 308 (or, when the electric potential is applied at a magnitude that at that is at least as great as the switching voltage).

As shown by comparison of FIGS. 3 and 4, when no electric potential or an electric potential less than the switching voltage is applied between or across the conductive and light transmissive layers 306, 308, the molecules 314 in the liquid crystals 312 of the diffusing layer 316 are randomly oriented. This random orientation can cause at least some of the light to be scattered or otherwise diffused by the molecules 314, as shown in FIG. 4. The arrowheads of the light distribution 204 represent the direction in which the light propagates through the diffusing layer 316. As shown in FIG. 4, some of the light is scattered by the molecules 314 thereby resulting in the light scattering in various directions during propagation through the diffusing assembly 216.

In contrast, when an electric potential is applied across the conductive and light transmissive layers 306, 308, as shown in FIG. 3, this potential generates electric field across or through the liquid crystal layer 316. This electric field can orient the molecules 314 of the liquid crystals 312 in the liquid crystal layer 316 toward or along common or parallel direction. The common orientation of the molecules 314 causes less light to be scattered by the molecules 314 relative to no or a lesser electric potential being applied across the conductive and light transmissive layers 306, 308. Consequently, less light in the light distribution 204 is scattered during propagation of the light through the diffusing assembly 216.

The application of the electric potential across the conductive and light transmissive layers 306, 308 can cause the diffusing layer 316 to become clearer (or more light transmissive) relative to no electric potential being applied or less electric potential being applied. As a result, less light is scattered and the shape of the distribution of light 204 can be smaller (relative to more light being scattered). This can reduce the throw angle of the distribution of the light.

Different amounts of electric potential can be applied across or between the conductive and light transmissive layers 306, 308 to cause different amounts of light scattering as the light propagates through the liquid crystal layer 316. For example, the amount or degree at which the light is scattered or diffused by the diffusing assembly 216 can be a function of the amount of electric potential applied across the conductive and light transmissive layers 306, 308. When a first amount electric potential is applied across the conductive and light transmissive layers 306, 308, less light may be scattered by the diffusing layer 316 relative to no electric potential being applied across the layers 306, 308. If a larger, second amount electric potential is applied across the layers 306, 308, the light may be scattered to a lesser degree or amount by the liquid crystal layer 316 then when no electric potential or the first electric potential is applied across the layers 306, 308. When an even larger, third electric potential is applied across the conductive and light transmissive layers 306, 308, even less light may be scattered or may be scattered to an even lesser degree than when no electric potential is applied across layers 306, 308, when the second electric potential is applied across layers 306, 308, or when the first electric potential is applied across layers 306, 308. As a result, the amount of light scattering caused by the diffusing assembly 216 may be a function of electric potential applied to the layers 306, 308, such as by the amount of light scattering being inversely proportional, inversely related, or otherwise related to the electric potential. This can cause the size or shape of the light distribution to be a function of the electric potential, such as the size or shape of the light distribution increasing for smaller electric potentials and the size or shape of the light distribution decreasing for larger electric potentials.

The scattering of the light can provide for controlling the shape of the light distribution 204, which can cover from the original beam angle 206 or 208 to a full lambertian distribution. While some energy of the light generated by the light source 200 may be reduced during propagation through the diffusing assembly 216, this loss may be less than 10% (or another threshold) of the energy of the light emitted by the light source 200. This energy loss can result in a small loss in lumens of the light, such as 4% or less.

In one aspect, the liquid crystal layer 316 may include one or more additional dopants to alter the light propagating therethrough. For example, in addition to the liquid crystals 312 in the liquid crystal layer 316, one or more inorganic ions (such as neodymium ions) or organic molecules may be added to the polymer matrix 310. These additional dopants can provide for color filtering of the light propagating through the liquid crystal layer 316 and the diffusing assembly 216 and for warm dimming of the light.

In one embodiment, visible light emitted by the light source 200 that is below a cut-off absorption wavelength of the diffusing layer 316 may be absorbed by the diffusing assembly 216 or one or more of the layers of the diffusing assembly 216. This can prevent the visible or ultraviolet light below the cut off absorption wavelength to not propagate through the diffusing assembly 216.

The conductive and light transmissive layers 316 may extend over the entire surface area of the liquid crystal layer 316 in one embodiment. Alternatively, one or more of the conductive and light transmissive layer 306, 308 may extend over part, but not all, of the surface area on either side of the liquid crystal layer 316. The conductive and light transmissive layer 316 and/or 308 may be patterned, or formed in the one or more discrete areas or sub-areas, to cause different amounts of light scattering when the electric potential is applied to the layers 306, 308 at a level below the switching voltage or is not applied to the layers 306, 308. Different patterns and/or shapes formed by the layer 306 and/or 308 can result in different changes in the shape of the distribution of the light that emanates from the diffusing assembly 214.

Figure 5:
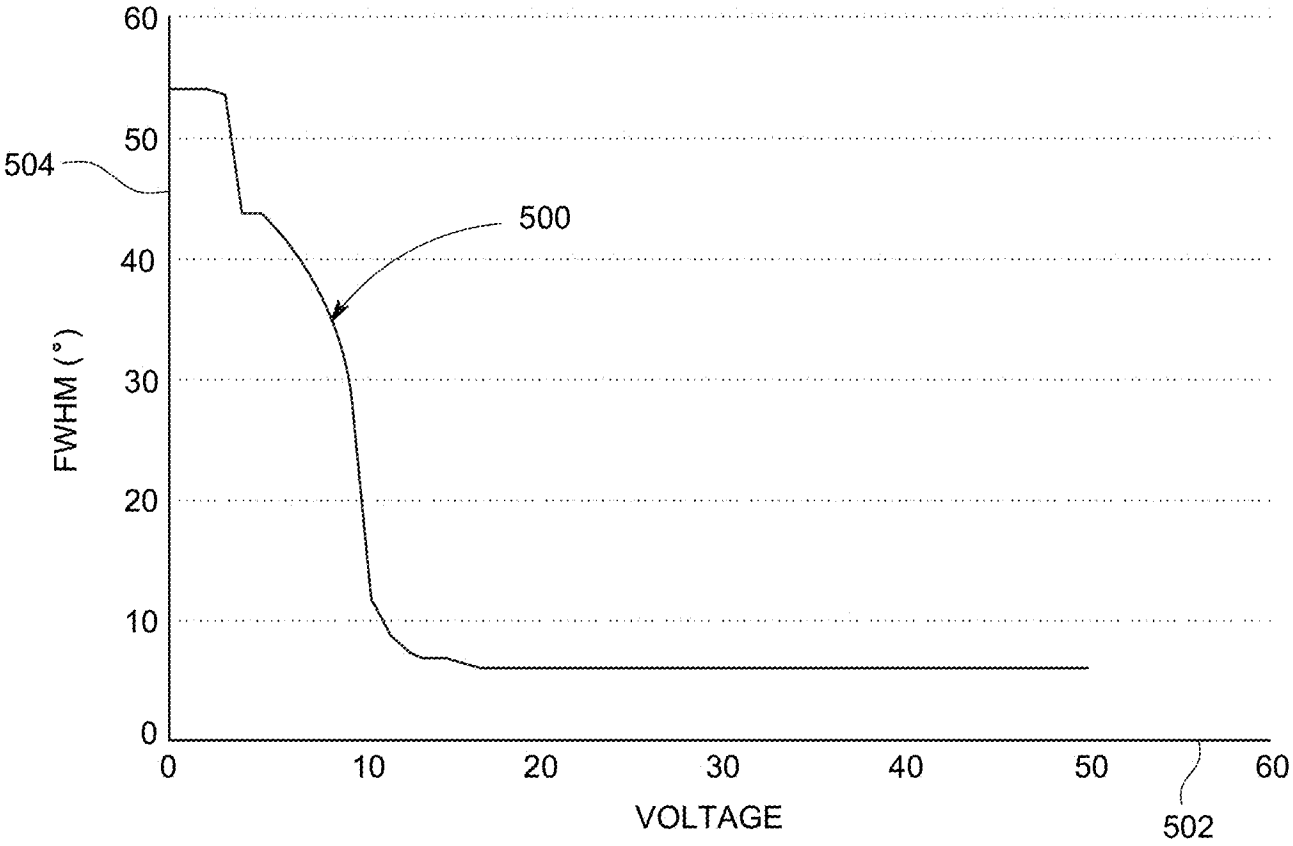
FIG. 5 illustrates one example of a relationship between light scattering in the diffusing assembly shown in FIG. 2 and electric potentials applied across conductive and light transmissive layers in the diffusing assembly shown in FIG. 3.

FIG. 5 illustrates one example of a relationship 500 between light scattering in the diffusing assembly 216 and electric potentials applied across the conductive and light transmissive layers 306, 308 in the diffusing assembly 216. The relationship 500 is shown alongside a horizontal axis 502 representative of different electric potentials applied across or between the conductive and light transmissive layers 306, 308 in the diffusing assembly 216 and a vertical axis 504 representative of the light scattering caused by the diffusing assembly 216. The amounts of scattering shown along the vertical axis 504 may represent intensities of the light emanating from the diffusing assembly 216, such as full widths of the distribution 204 of the light at half maximum of intensity, or FWHM.

As the electric potential applied across the conductive and light transmissive layers 306, 308 increases, the amount of light scattering caused by the diffusing assembly 216 decreases because the diffusing layer 316 becomes clearer with increasing electric potentials. Conversely, reducing the electric potential applied across the conductive and light transmissive layers 306, 308 increases the amount of scattering caused by the diffusing assembly 216. Using the relationship 500, the lighting system 100 or an operator of the lighting system 100 can vary the electric potential applied across the conductive and light transmissive layers 306, 308 along a continuous range of potentials in order to continuously vary or alter the amount of light scattering. Consequently, the amount or degree of light scattering caused by the diffusing assembly 216 can be selected by changing the electric potential applied across the conductive and light transmissive layers 306, 308.

Figure 6:
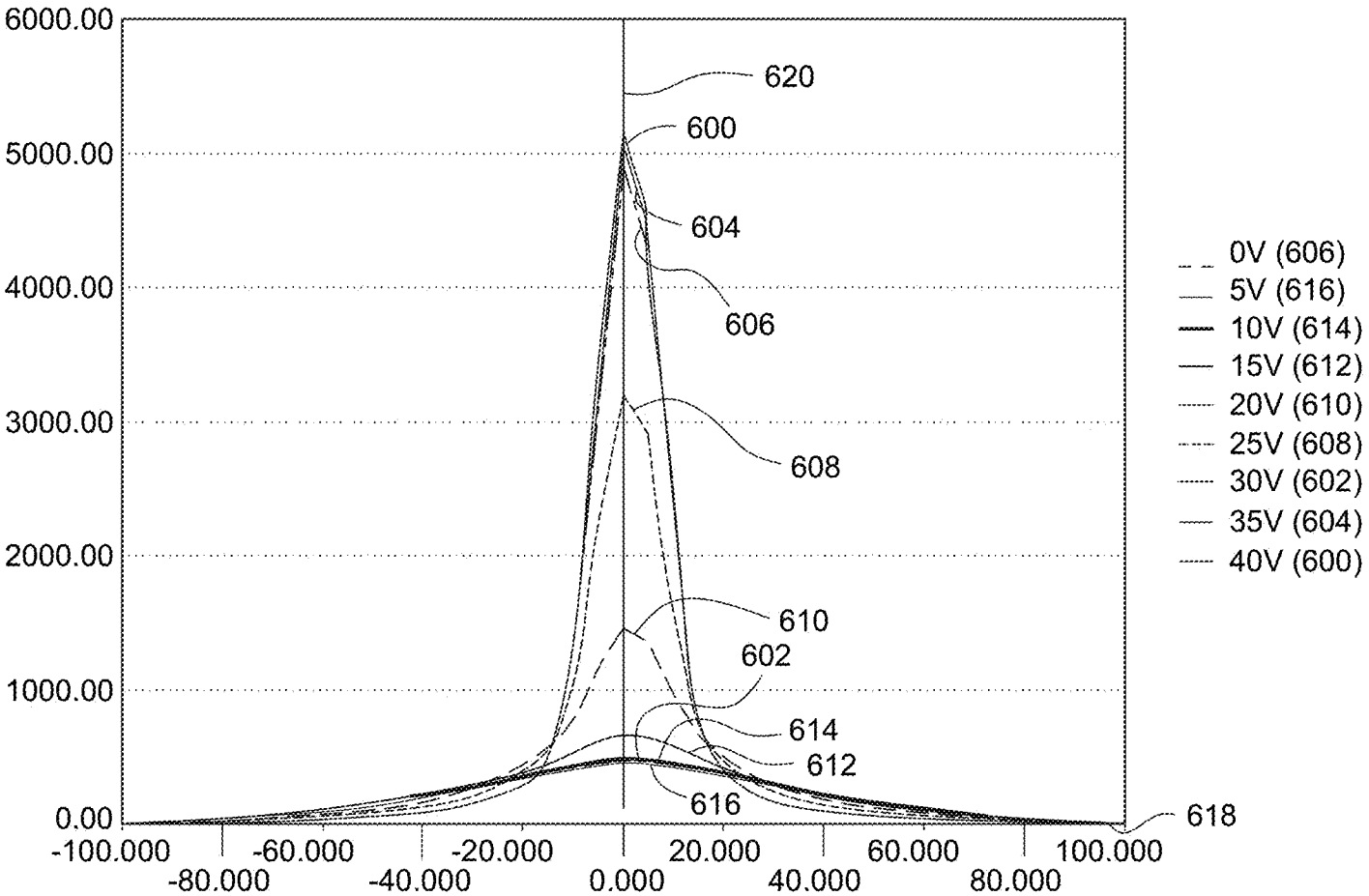
FIG. 6 illustrates examples of different shapes of distribution of light emanating from the diffusing assembly at different electric potentials applied across or between the conductive and light transmissive layers of the diffusing assembly.

FIG. 6 illustrates examples of different shapes of the distribution 204 of light emanating from the diffusing assembly 216 at different electric potentials applied across or between the conductive and light transmissive layers 306, 308. The different shapes include distribution shapes 600, 602, 604, 606, 608, 610, 612, 614, 616, which are shown alongside a horizontal axis 618 representative of different angles from the direction 212 (shown in FIG. 2) of the distribution 204 of light and a vertical axis 620 representative of relative intensities of the light at the different angles. The location of the vertical axis 620 along the horizontal axis 618 can represent the direction 212 shown in FIG. 2.

The angles represented by the horizontal axis 618 can represent angles to one or more sides of the direction 212 in which the light is generated or emanates from the lighting system 100, as shown in FIG. 2. For example, the location along the horizontal axis 618 at a value of 20° can represent an angle that is 20° to the right of the direction 212 shown in FIG. 2, a location along the horizontal axis 618 of negative 40° can represent an angle that is 40° to the left of the direction 212 shown in FIG. 2, and so on.

The different distribution shapes shown in FIG. 6 represent different shapes of the distribution 204 of the light for different electric potentials applied across or between the layers 306, 308 in the diffusing assembly 216. At larger amounts of electric potential, less diffusion of the light occurs while, at smaller amounts of electric potential, more diffusion of the light occurs.

Figure 7:
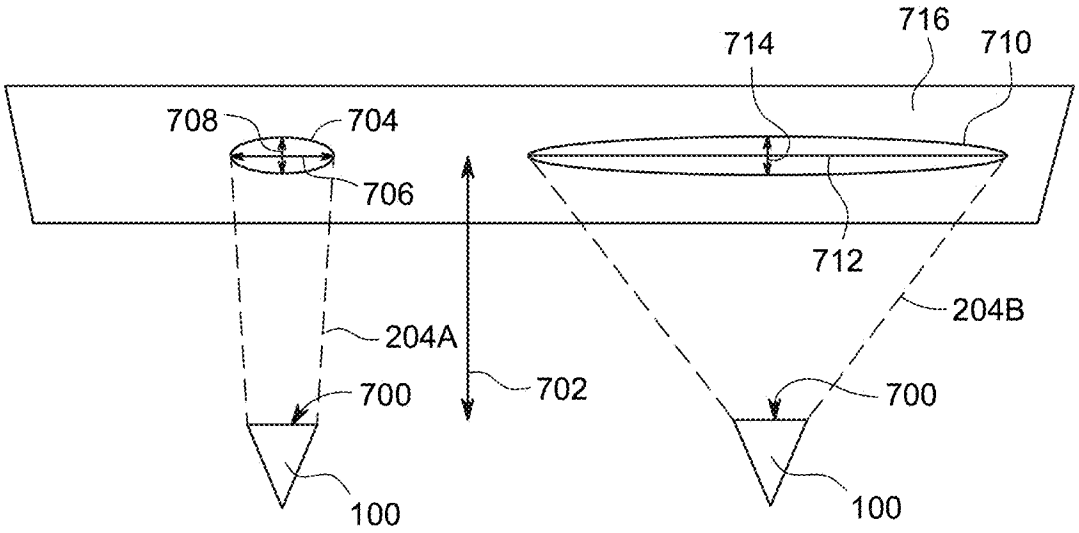
FIG. 7 illustrates operation of the diffusing assembly of the lighting system according to one example.

FIG. 7 illustrates operation of the diffusing assembly 216 of the lighting system 100 according to one example. Two lighting systems 100 are shown in FIG. 7. The lighting systems 100 each emit light from an upper or light emitting surface 700, which can represent the outer surface of the lens 104 shown in FIGS. 1 and 2. The light emitting surfaces 700 of the two lighting systems 100 may be the same distance 702 from a common plane or surface 716. The surface or plane 716 may represent a floor, wall, or other surface.

The lighting system 100 on the left side of FIG. 7 may have an electric potential applied across the layers 306, 308 that is greater than the switching voltage of the diffusing assembly 216. The lighting system 100 on the right side of FIG. 7 may have no electric potential applied across the layers 306, 308, may have an electric potential applied that is less than the blocking voltage of the diffusing assembly 216, or may have an electric potential applied that is less than the lighting system 100 on the left side of FIG. 7. The shapes or spread of the distributions 204A, 204 B of the light emitted by the lighting systems 100 shown in FIG. 7 may differ.

Because the diffusing layer 316 in the diffusing assembly 216 of the lighting system 100 on the left side of FIG. 7 may be more clear (due to the larger electric potential), the shape or size of the distribution 204A of the light may be tighter or smaller than the shape or size of the distribution 204B of the light emitted from the lighting system 100 on the right side of FIG. 7. The light in the distributions 204A, 204B may be cast upon the surface 716 at different intensities and/or in different shapes. Areas 704, 710 represent areas illuminated by the light in the distributions 204A, 204B. These areas 704, 710 may be defined by outer dimensions of 706, 708 for the area 704 and outer dimensions 712, 714 for the area 710. As shown in FIG. 7, the spread or size of the distribution 204B of the light emitted by the lighting system 100 having no electric potential or a smaller electric potential applied across or between the layers 306, 308 may be wider or larger than the shape of the distribution 204A of the light emitted by the lighting system 100 (which has a larger or at least some electric potential applied across the layers 306, 308). This is due to the increased amount of scattering in the light that propagates through the diffusing assembly 216 in the lighting system 100 on the right side of FIG. 7.

Figure 8:
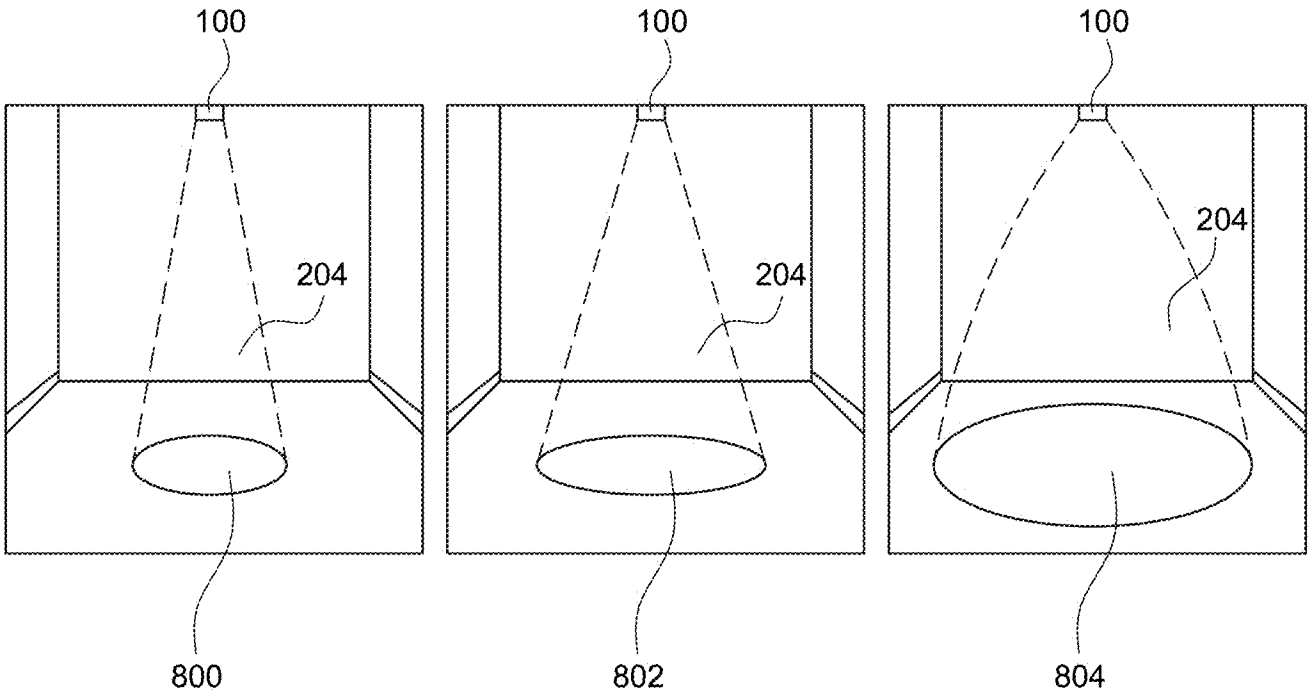
FIG. 8 illustrates additional examples of changing the shape or size of the distribution of light emitted by the lighting system shown in FIG. 1.

FIG. 8 illustrates additional examples of changing the shape or size of the distribution 204 of light emitted by the lighting system 100 shown in FIG. 1. The same lighting system 100 casts a distribution 204 of light toward a surface, such as a floor of a room. When a first amount of electric potential is applied across the conductive and light transmissive layers 306, 308 of the diffusing assembly 216 in the lighting system 100, the distribution 204 of the light is smaller and, as a result, a smaller illuminated area 800 is cast on the floor. When this electric potential applied across the layers 306, 308 is decreased, the shape of the distribution 204 of the light emitted by the lighting system 100 is larger, as shown by the larger illuminated area 802 in FIG. 8. When this electric potential is decreased even more, the size of the shape of the distribution 204 of the light emitted by the lighting system 100 is even larger, as shown by the largest illuminated area 804 shown in FIG. 8.

In addition or as an alternate to changing the shape of the distribution 204 of the light emitted from the lighting system 100, the direction 212 in which the light is emitted from the lighting system 100 can be changed by changing the electric potential applied to one or more of the assemblies 216, 218 shown in FIG. 2. As described above, the shape or size of the distribution 204 of light can be altered electrically by changing, applying, or removing electric potential applied across or between conductive layers in the diffusing assembly 216. The shape or size of the distribution 204 of light can be altered without mechanically moving the light source 200, lens 104, diffusing assembly 216, or any other component or part of the lighting system 100.

The direction 212 in which the distribution 204 of the light is oriented optionally may be changed by electrically changing an amount of electric potential applied to a reflective assembly 218 of the lighting system 100 and/or by changing the amount of electric potential applied to the diffusing assembly 216.

Figure 9:
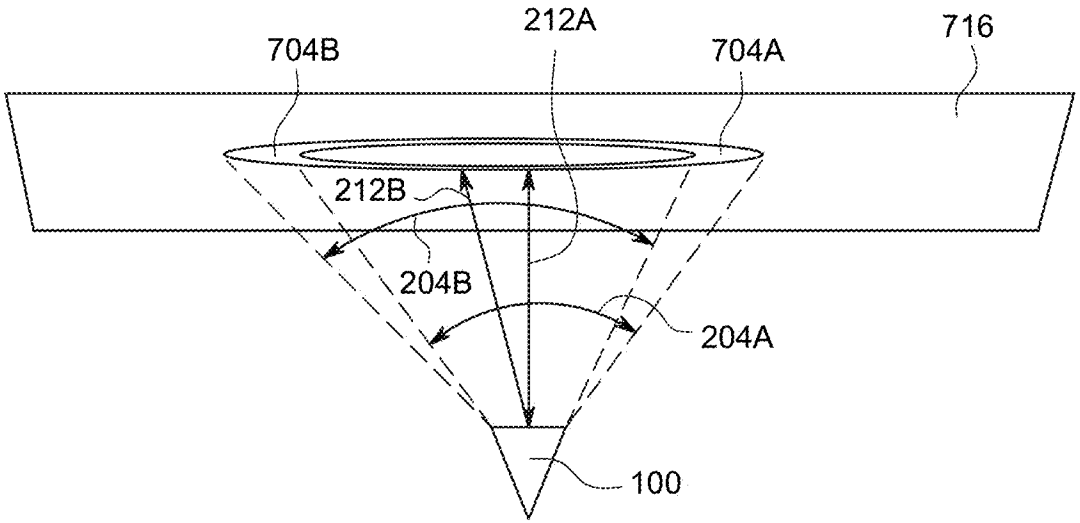
FIG. 9 illustrates operation of the lighting system by changing a direction in which the distribution of the light is electrically controlled according to one example.

FIG. 9 illustrates operation of the lighting system 100 by changing a direction 212, 214 in which the distribution 204 of the light is electrically controlled according to one example. In FIG. 9, the lighting system 100 may emit light to have the distribution 204A toward the surface 716 to illuminate the area 704A on the surface 716. The distribution 204A of the light is oriented along a first direction 212A. In order to laterally shift the distribution 204A of light in a different direction 212B, an electric potential can be applied to the reflective assembly 218 to cause the light to have the distribution 204B, which is oriented in a different direction 212B and that illuminates a different area 704B on the surface 716. In one aspect, the lighting system 100 can include multiple, different reflective assemblies 218 with different potentials applied (or not applied) to the reflective assemblies 218 in order to alter the direction of the light.

Figure 10:
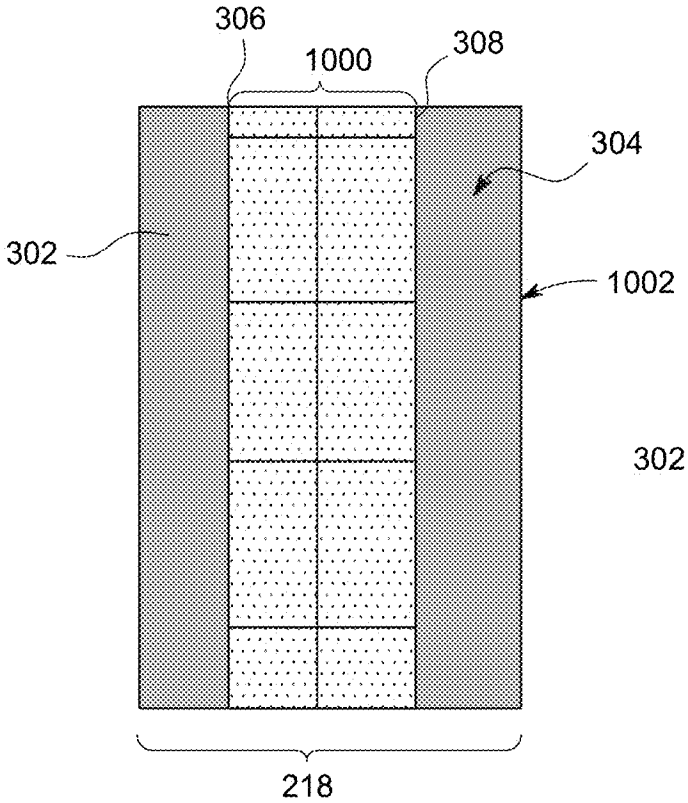
FIG. 10 illustrates a cross-section of one embodiment of a reflective assembly shown in FIG. 2.

FIG. 10 illustrates a cross-section of one embodiment of the reflective assembly 218 shown in FIG. 2. The reflective assembly can include a diffusing layer 1000, which may be similar or identical to the diffusing layer 316 shown in FIGS. 3 and 4. Alternatively, the diffusing layer 1000 may differ from the diffusing layer 316 in that the diffusing layer 1000 may include a different polymer matrix 310, different liquid crystals 312, different liquid crystal molecules 314, different amounts or densities of the liquid crystals 312 and/or molecules 314, or the like. The diffusing layer 1000 is disposed between opposite conductive and light transmissive layers 306, 308, which may be the same as or similar to the layers 306, 308 in the diffusing assembly 216. Layers 302, 304 may be the same or similar to the layers 302, 304 in the diffusing assembly 216.

One difference between the reflective assembly 218 and the diffusing assembly 216 is that the reflective assembly 218 includes a reflective layer 1002. The reflective layer 1002 reflects the light entering into the reflective assembly 218. The reflective layer 1002 can represent a metallized layer or coating (for example, an aluminum or other metallic coating) on an opposite side of the polymer layer 304 than the conductive and light transmissive layer 308 shown in FIG. 10.

In operation, light emitted by the light source 200 can propagate through the polymer layer 302 of the reflective assembly 218, through the first conductive and light transmissive layer 306, through the diffusing layer 1000 (where the light may or may not be scattered), through the second conductive and light transmissive layer 308, through the second polymer layer 304, be reflected off of the reflective layer 1002, and then propagate back through the polymer layer 304, the conductive and light transmissive layer 308, the diffusing layer 1000 (where the light may be scattered), the first conductive and light transmissive layer 306, the first polymer layer 302, and out of the reflective assembly 218.

Applying electric potential across the layers 306, 308 in the reflective assembly 218 can cause the layer 1000 scatter or not scatter the light, as described above in connection with the diffusing assembly 216. Applying, removing, or changing electric potential applied across the conductive and light transmissive layers 306, 308 of the reflective assembly 218 can change the specularity of the assembly 218. In one aspect, the specularity of the reflective assembly 218 can be measured as the cosine of an angle made by a direction of light onto or into the reflective assembly 218 to an angle made by the light that is reflected off of an out of the reflective assembly 218.

When no electric potential is applied across the layers 306, 308 of the reflective assembly 218 (or when a potential that is less than the switching voltage of the diffusing layer 1000 is applied across the conductive and light transmissive layers 306, 308), light passing into the reflective assembly 218 is scattered upon first passage through the diffusing layer 1000. This scattered light is then reflected off of the reflective layer 1002 and travels back into the diffusing layer 1000, where the light may again be scattered before emanating from the reflective assembly 218 via the polymer layer 302. The scattering of the light by the diffusing layer 1000 prior to and/or subsequent to reflection of the light off of the reflective layer 1002 can cause a decrease in the specularity of the reflective assembly 218. Conversely, applying an electric potential across the layers 306, 308 can cause less scattering of the light by the diffusing layer 1000 prior to and/or subsequent to reflection of the light off of the reflective layer 1002. This can cause an increase in specularity of the reflective assembly 218, as the reflective assembly 218 becomes more reflective to the light. Changing the clarity or amount of scattering in the diffusing layer 1000 can vary the specularity and, as a result, the direction at which the light emanates from the reflective layer 218.

Figure 11:
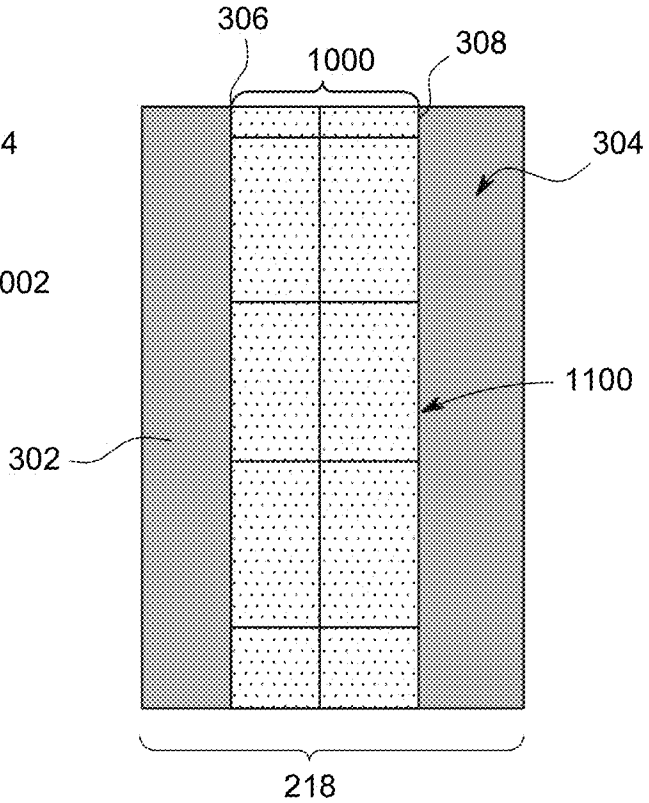
FIG. 11 illustrates an alternative embodiment of the reflective assembly shown in FIG. 2.

FIG. 11 illustrates an alternative embodiment of the reflective assembly 218 shown in FIG. 2. In contrast to the embodiment of the reflective assembly 218 shown in FIG. 10, the reflective assembly 218 shown in FIG. 11 includes a conductive and reflective layer 1100 between the diffusing layer 1000 and the second polymer layer 304. The reflective assembly 218 shown in FIG. 11 may not include the separate reflective layer 1002. Instead, the layer 1100 operates as both the reflective layer 1002 and the conductive and light transmissive layer 308 of the reflective assembly 218 shown in FIG. 10.

In contrast to the reflective assembly 218 shown in FIG. 10, light that is reflected by the reflective assembly 218 does not pass through the second polymer layer 304 before or after being reflected by the reflective layer 1100. The reflective layer 1100 may be formed from a conductive and reflective layer, such as a metallized layer (for example, formed from aluminum or other reflective conductive material). The potential that is applied in order to change the clarity or scattering of the liquid crystal layer 1000 may be applied between or across the conductive and light transmissive layer 306 and the reflective layer 1100.

Figure 12:
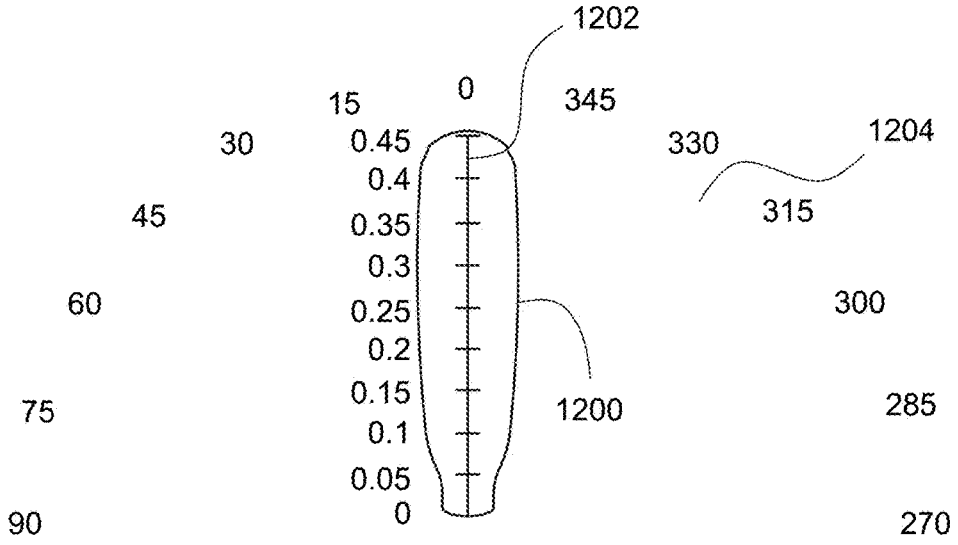
FIG. 12 represents a distribution of light reflected off of the reflective assembly according to a first example.

FIG. 12 represents a distribution 1200 of light reflected off of the reflective assembly 218 according to a first example. The distribution 1200 represents the spread of the light reflected by the reflective assembly 218 when the electric potential applied across or between the conductive layers on opposite sides of the diffusing layer 1000 shown in FIGS. 10 and 11 is at or above the switching voltage of the diffusing layer 1000. The distribution 1200 is shown alongside a linear vertical axis 1202 representative of intensities of the light reflected off of the reflective assembly 218 and alongside an angular axis 1204 representative of angles relative to a normal or perpendicular direction to the polymer layer 302 of the reflective assembly 218. The vertical axis 1202 can represent the direction that is normal or perpendicular to the surface of the first polymer layer 302 of the reflective assembly 218.

The distribution 1200 of the light can indicate or represent the specularity of the reflective assembly 218. As shown in FIG. 12, the distribution 1200 of the light reflected off of the reflective assembly 218 is relatively small or tightly constrained due to the highly specular characteristic of the reflective assembly 218. The distribution 1200 of the light may be relatively tight or narrowly constrained due to the diffusing layer 1000 being relatively clear due to application of electric potential between the conductive layers on opposite sides of diffusing layer 1000, as described above in connection with diffusing assembly 216.

Figure 13:
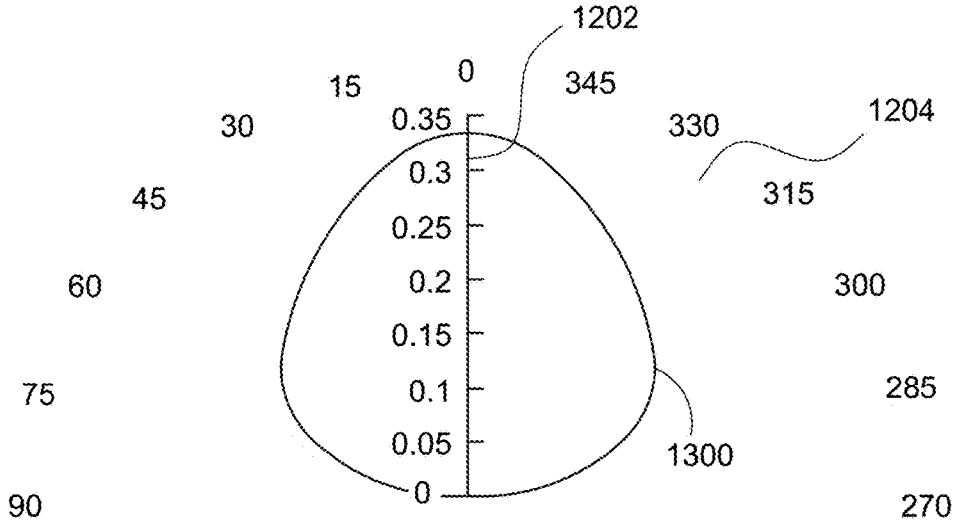
FIG. 13 represents a distribution of light reflected off of the reflective assembly according to a second example.

FIG. 13 represents a distribution 1300 of light reflected off of the reflective assembly 218 according to a second example. The distribution 1300 represents the spread of the light reflected by the reflective assembly 218 when the electric potential applied across or between the conductive layers on opposite sides of the diffusing layer 1000 shown in FIGS. 10 and 11 is not at or above the switching voltage of the diffusing layer 1000 (or when no electric potential is applied). The distribution 1300 of the light may be broader or less tightly constrained relative to the distribution 1200 due to the diffusing layer 1000 being less clear due to absence of electric potential or a smaller electric potential applied between the conductive layers on opposite sides of diffusing layer 1000.

Changing the specularity of the reflective assembly 218 may change the distribution of the light emanating from the lighting system 100. Similar to the amount of scattering in the diffusing assembly 216 being a function of the magnitude of electric potential applied across or between the conductive layers on opposite sides of a diffusing layer, the specularity of the reflective assembly 218 also can be a function of the magnitude of electric potential applied across or between the conductive layers on opposite sides of the liquid crystal layer in the reflective assembly 218. Changing the specularity of the reflective assembly 218 may change how the light is reflected inside the lighting assembly 100 and, consequently, alter the direction in which light emanates from the lighting system 100. The specularity of the reflective assembly 218 may be variable with respect to the different electric potentials applied to the conductive layers on opposite sides of the liquid crystal layer 1000, which can allow for many varied different directions or profiles or distributions of the light relative to some known directional lamps or luminaires.

Figure 14:
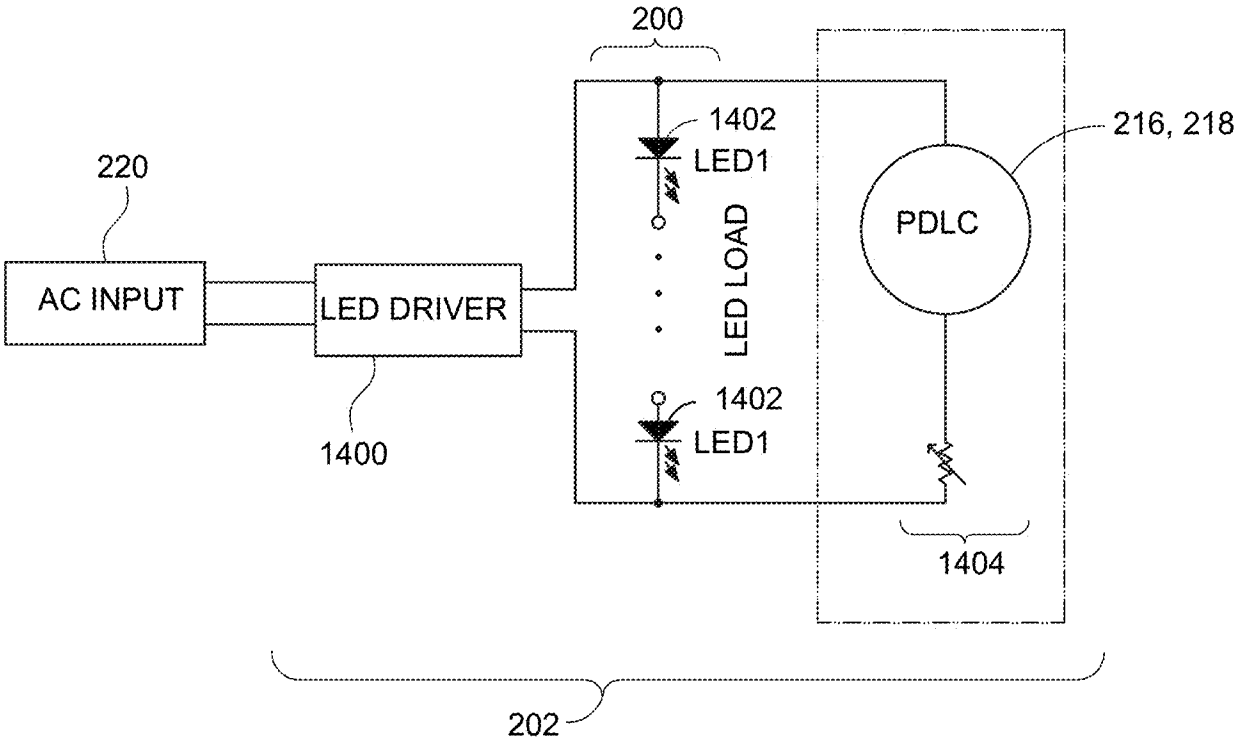
FIG. 14 illustrates a circuit diagram of the power supply circuit shown in FIG. 2 according to one embodiment.

FIG. 14 illustrates a circuit diagram of the power supply circuit 202 shown in FIG. 2 according to one embodiment. The power supply circuit 202 may be operably coupled with the power supply 220 which is shown as an alternating current input in FIG. 14 ("AC Input" in FIG. 14). Alternatively, the power supply 220 may be another type of or source electric current. The power supply circuit 202 includes a driver 1400 which may be conductively coupled with the power supply 220 in order to receive current, such as alternating current, from the power supply 220. The driver 1400 may be an LED driver that regulates electric power supplied to the light source 200. The driver 1400 may respond to changing demands of the light source 200 by providing a constant or substantially constant quantity of electric power to the light source 200.

The light source 200 is illustrated in FIG. 14 as including a string or series of light emitting diodes 1402. The light source 200 is connected between the driver 1400 and one or more of the diffusing assembly 216 and/or the reflective assembly 218. The assemblies 216, 218 may each be referred to as an electro-active optical component or may collectively be referred to as an electro-active optical component. For example, the light source 200 may be connected with the driver 1400 in parallel with the diffusing assembly 216 and/or the reflective assembly 218. While the diffusing assembly 216 and/or reflective assembly 218 are represented by a polymer dispersed liquid crystal (PDLC) device in FIG. 14, alternatively, one or more of the diffusing assembly 216 and/or reflective assembly 218 may be formed from a liquid crystal layer other than a PDLC device.

The power supply circuit 202 can include a control device 1404 that is used to control the amount of current supplied to the diffusing assembly 216 and/or the reflective assembly 218. In one aspect, the control device 1404 can represent a potentiometer or other device having a resistance that can be changed. The control device 1404 and the diffusing assembly 216 and/or the reflective assembly 218 may be connected in series with each other and in parallel with the light source 200. In operation, the control device 1404 may change the resistance provided by the control device 1404 to change how much electric potential is supplied to the conductive layers on opposite sides of the diffusing layers in the diffusing assembly 216 and/or the reflective assembly 218. As described above, changing the electric potential can change the distribution of light that emanates from the lighting system 100. In one embodiment, multiple control devices 1404 may be provided, with one control device 1404 controlling the electric potential applied to the conductive layers on opposite sides of the diffusing layer in the diffusing assembly 216 and another control device 1402 controlling the electric potential supplied to the conductive layers on opposite sides of the diffusing layer in the reflective assembly 218. As a result, these control devices 1404 can independently control how the diffusing assembly 216 changes the distribution 204 of the light and how the reflective assembly 218 controls the distribution 204 of light. Alternatively, a single control device 1404 may control the electric potential supplied to both the diffusing assembly 216 and the reflective assembly 218.

The power supply circuit 202 diverts at least some of the electric current away from the light source 200 and conducts this diverted current to the diffusing assembly 216 and/or reflective assembly 218, while the light source 200 continues to receive sufficient electric current to continue generating the light. For example, the power supply circuit 202 may tap off of the power supply to the light source 200 while the light source 200 is generating light in order to apply the electric potentials to the diffusing assembly 216 and/or reflective assembly 218 to make either or both assemblies 216, 218 more clear as described above.

The switching voltages for different types of liquid crystal layers may differ. For example, for liquid crystal layers formed from PDLC, the switching voltage may be between twenty and one hundred volts. For liquid crystal layers formed from polymer network liquid crystal (PNLC) or twisted nematics (TN), the switching voltage can be between three and five volts. Alternatively, the liquid crystal layers 316, 1000 and one or more of the diffusing assembly 216 and/or reflective assembly 218 may have different or other switching voltages.

Figure 15:
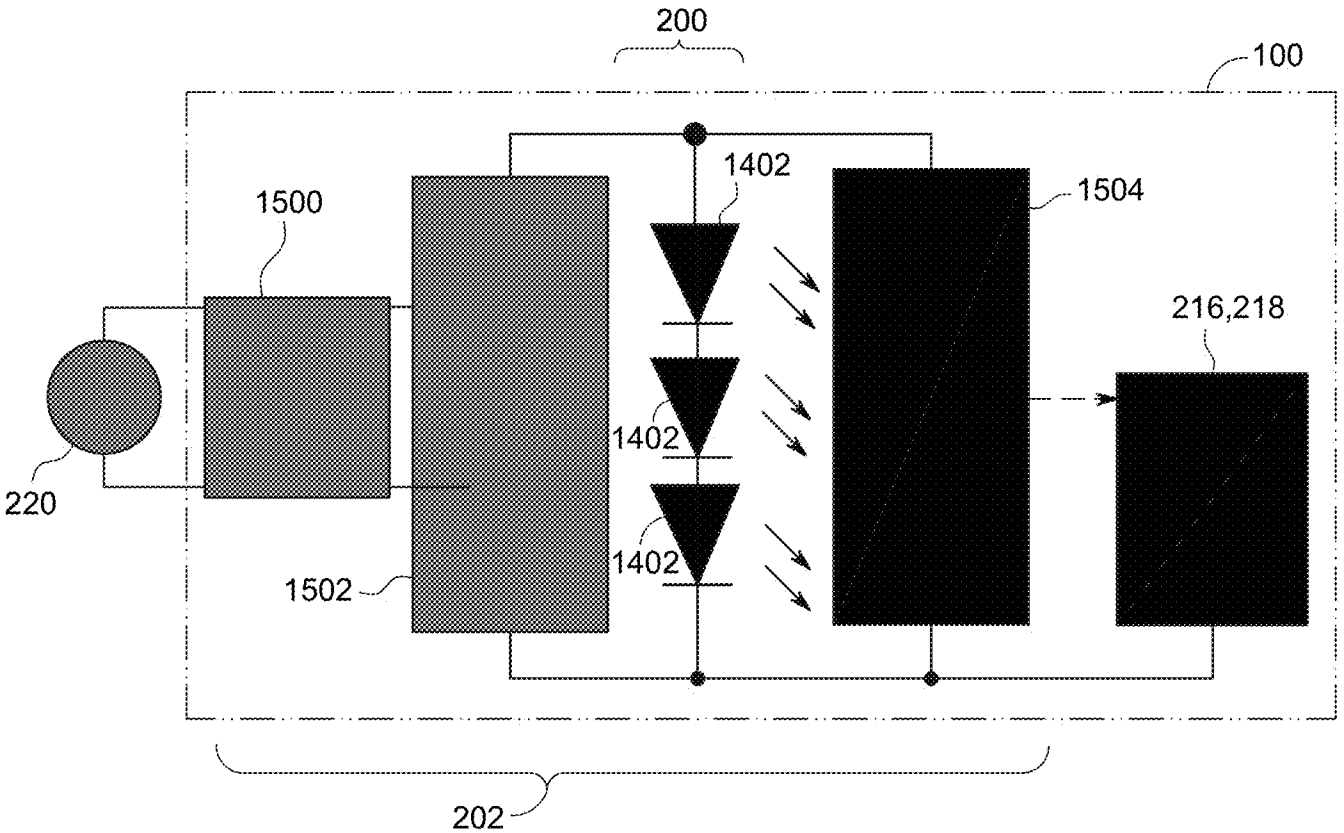
FIG. 15 illustrates another embodiment of the power supply circuit.

FIG. 15 illustrates another embodiment of the power supply circuit 202. The power supply circuit 202 shown in FIG. 15 includes a rectifier 1500 that receives alternating current from the power supply 220. The rectifier 1500 converts the alternating current into a direct current that is supplied to a driver 1502, such as an LED driver or the driver 1400 shown in FIG. 14. As described above in connection with FIG. 14, the light source 200 may represent plural light devices 1402, such as LEDs, connected in series with each other in parallel with the driver. A control device 1504 also may be connected with the LED driver 1502 in parallel with the light source 200. The control device 1504 may represent the control device 1404 shown in FIG. 14. The control device 1504 may divert some of the current supplied by the driver 1502 from the light source 200 to one or more of the diffusing assembly 216 and/or the reflective assembly 218, as described above. This can allow for the light source 200 to generate light concurrently with the electric potential being applied to either or both assemblies 216, 218 to change the scattering of light by either or both assemblies 216, 218.

Figure 16:
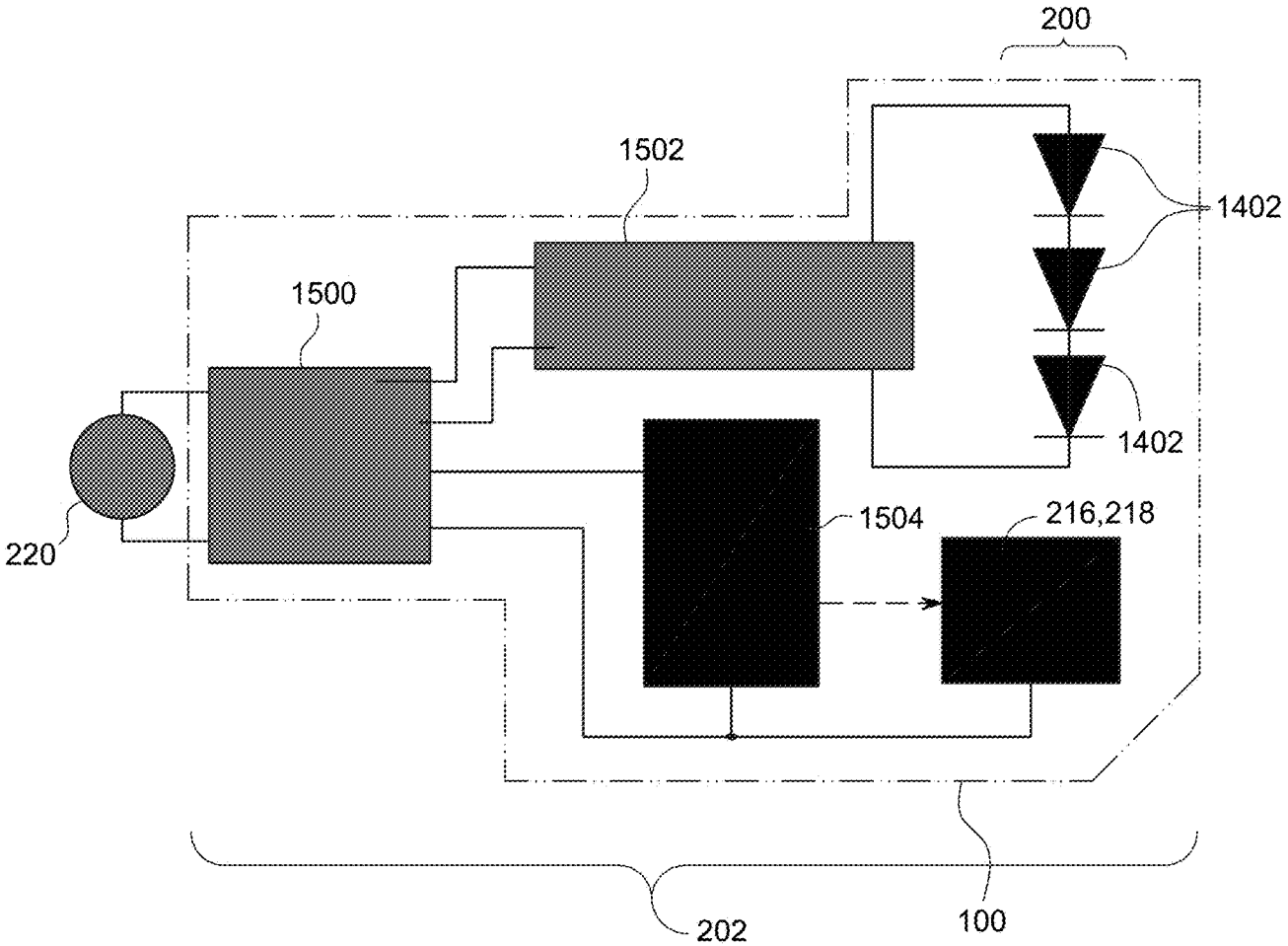
FIG. 16 illustrates another embodiment of the power supply circuit.

FIG. 16 illustrates another embodiment of the power supply circuit 202 shown in FIG. 1. The power supply circuit 202 shown in FIG. 16 includes the rectifier 1500 connected with the power supply 220. The power supply 220 may supply alternating current to the rectifier 1500, which is modified into a direct current. The rectifier 1500 supplies this direct current to the driver 1502, which supplies the current to the light source 200 to power the light source to generate the light. In contrast to the power supply circuit 202 shown in FIG. 15, the control device 1504 and the power supply circuit 202 shown in FIG. 16 is not connected with the driver 1502 in parallel with the light source 200. Instead, the control device 1504 and the assemblies 216, 218 shown in FIG. 16 are connected in series with each other in a branch of the circuit 202 that does not include the driver 1502 or the light source 200.

Figure 17:
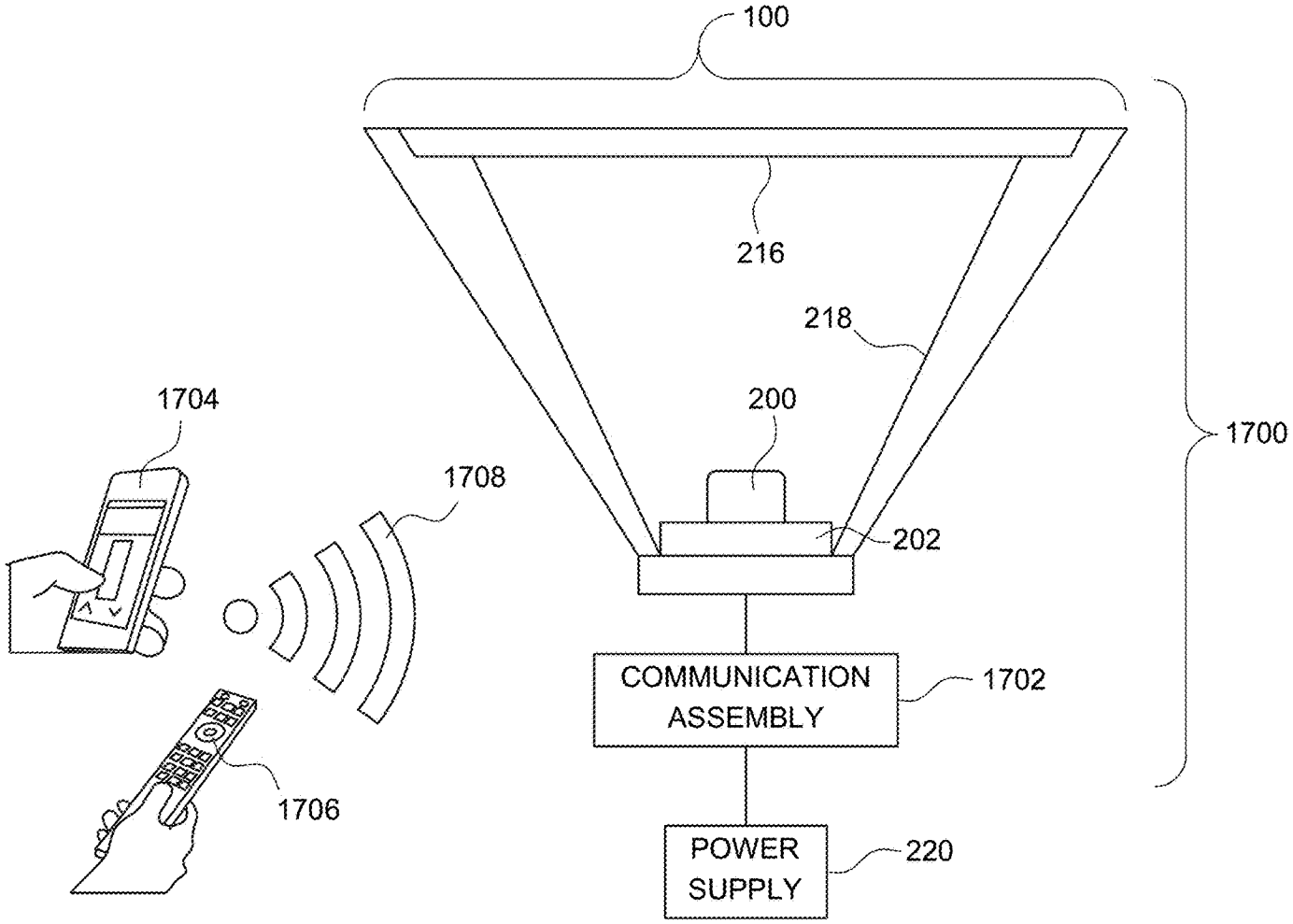
FIG. 17 illustrates a control system for the lighting system shown in FIG. 1 according to one embodiment.

FIG. 17 illustrates a control system 1700 for the lighting system 100 according to one embodiment. The control system 1700 includes a communication assembly 1702 that is connected with the assemblies 216, 218 and/or the light source 200, such as via the power supply circuit 202. In the illustrated embodiment, the communication assembly 1702 also is connected with the power supply 220. In another embodiment, however, the communication assembly 1702 may not be connected with the power supply 220 the supplies power to light source 204/or the assemblies 216, 218.

The communication assembly 1702 represents hardware circuitry that includes and/or is connected with transceiving hardware or receiving hardware that can wirelessly communicate with one or more remote control devices 1704, 1706. For example, the communication assembly 1702 may include one or more antennas, Bluetooth receivers, demodulators, network adapters, or the like, that can receive a wireless signals 1708 from one or more of the remote control devices 1704, 1706. The wireless signal 1708 can direct the power supply circuit 202 of the lighting system 100 to supply amount of current or electric potential to one or more of the assemblies 216, 218. In response to receiving the wireless signal 1708, the communication assembly 1702 can direct the power supply circuit 202 to supply the appropriate or requested current to one or more of the assemblies 216, 218 so that the appropriate assembly 216, 218 applies, removes, or changes the electric potential applied across or between the conductive layers and opposite sides of liquid crystal layer to change the distribution of light emanating from the lighting system 100.

The remote control devices 1704, 1706 can represent one or more electronic devices capable of communicating the wireless signal 1708 to the communication assembly 1702. In the illustrated embodiment, the remote controlled by 1704 represents a mobile phone or tablet computer capable of sending the wireless signal 1708. The remote control device 1706 shown in FIG. 17 is illustrated as a remote control having buttons or other devices for generating and sending the wireless signal 1708 to the communication assembly 1702. Optionally, the lighting system 100 may include a switch or other input device, or may be connected with the switch or other input device. The switch or input device may be actuated by an operator to cause the power supply circuit 202 to apply, remove, or change the electric potential supplied to one or more of the assemblies 216, 218.

Figure 18:
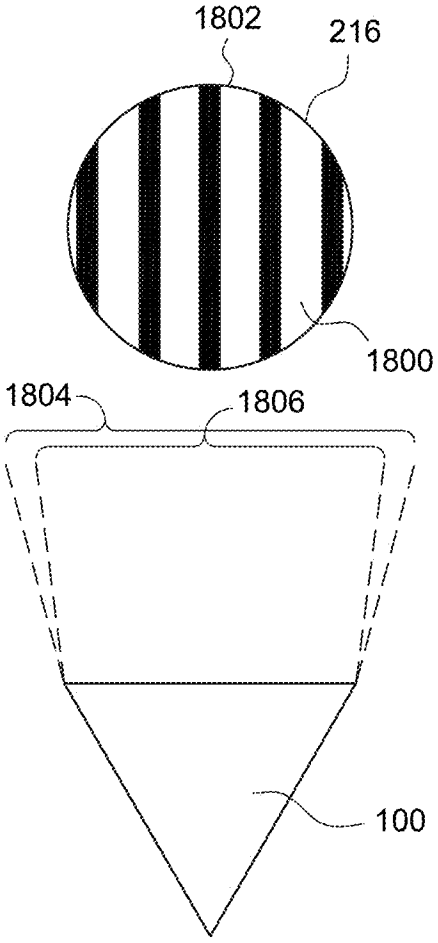
FIG. 18 illustrates another embodiment of the diffusing assembly shown in FIG. 2.

FIG. 18 illustrates another embodiment of the diffusing assembly 216 shown in FIG. 2 and the lighting system 100. The diffusing assembly 216 may include the liquid crystal layer 316 and/or the conductive layers 306, 308 extending over the entire surface area of the diffusing assembly 216 through which light enters and/or exits the diffusing assembly 216. Alternatively, the liquid crystal layer 316 and/or conductive layers 306, 308 may extend over only a portion, but not all, of the surface area through which the light enters and/or exits the diffusing assembly 216. In FIG. 18, the diffusing assembly 216 includes first areas 1800 and different, non-overlapping second areas 1802. The number, size, shapes, and arrangement of the areas 1800, 1802 shown in FIG. 18 are provided as one example, and are not limiting on all embodiments of the subject matter described herein.

One of the areas 1800 or 1802 represents the locations in the diffusing assembly 216 where the liquid crystal layer 316 and/or the conductive layers 306, 308 are located, while the other areas 1802 or 1800 represents the locations in the diffusing assembly 216 where the liquid crystal layer 316 and/or the conductive layers 306, 308 are not located. Separating the areas where the liquid crystal layer 316 and/or layers 306, 308 are located can allow for different distributions 1804, 1806 of the light to emanate from the lighting system 100. For example, having only discrete areas of the diffusing assembly 216 alternate between clear or different levels of scattering the light can allow for various distributions 1804, 1806 of the light to be achieved. In one aspect, changing the scattering of the light in the areas 1800 or 1802 (by applying or removing the electric potential across the areas 1800 or 1802) can cause the light to emanate from the lighting system 100 in the distribution 1804 while not changing the scattering of the light in the areas 1800 or 1802 can cause the light to emanate in the distribution 1806.

Figure 19:
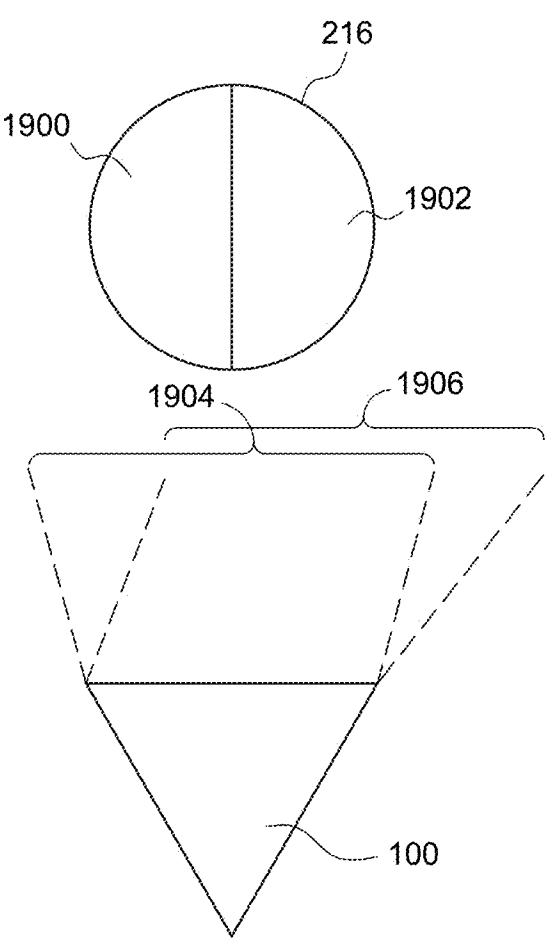
FIG. 19 illustrates another embodiment of the diffusing assembly shown in FIG. 2 and the lighting system.

FIG. 19 illustrates another embodiment of the diffusing assembly 216 shown in FIG. 2 and the lighting system 100. The diffusing assembly 216 may be used to change the distribution of the light emanating from the lighting system 100 by changing the shape of the distribution of light and/or by changing the direction in which the light emanates from the lighting system 100. Similar to the diffusing assembly 216 shown in FIG. 18, the diffusing assembly 216 shown in FIG. 19 may have different areas 1900, 1902, with one area 1900 or 1902 including the liquid crystal layer 316 and/or the conductive layers 306, 308 and the other area 1902 or 1900 not including one or more of the liquid crystal layer 316 or the conductive layers 306, 308.

When an electric potential is applied to the area 1900 or 1902 having the liquid crystal layer and conductive layers, this area 1900 or 1902 may become more clear and cause the lighting system 100 to generate the light along a distribution 1904 shown in FIG. 19. Removing or reducing this electric potential across the conductive layers in the area 1900 or 1902 having the liquid crystal layer and conductive layers, however, can cause increased scattering of light passing through the area 1900 or 1902, as described above. As a result, the light may be directed to one side and cause the lighting system 100 to generate a different distribution 1906 of light. As shown in FIG. 19, this can result in the direction in which the light emanates from the lighting system 100 to change. The diffusing assembly 216 therefore can be used to change the shape of the distribution of light (e.g., by causing the light to be cast or thrown over a larger or smaller area depending on the amount of scattering caused by the diffusing assembly 216) and/or to change the direction in which the distribution of light is cast (e.g., by directing the light to one side or another of the lighting system). The reflective assembly 218 may be used to additionally steer (e.g., control) the direction of the distribution of light, or the lighting system 100 may use the diffusing assembly 216 without the reflective assembly 218 to control the direction of the light distribution.

While the lighting systems 100 illustrated herein include a single diffusing assembly 216 between the light source 200 and one or more target objects onto which the light is generated toward (e.g., persons, floors, walls, ceilings, etc.), alternatively, two or more diffusing assemblies 216 may be between the light source 200 and the target objects. For example, plural diffusing assemblies 216 may be stacked or serially aligned with each other such that at least one of the diffusing assemblies 216 is between the light source 200 and one or more other diffusing assemblies 216. This can allow for additional or alternative control over the distribution of light emanating from the lighting system 100.

The lighting systems 100 described herein can provide for different control over distributions of light emanating from the systems 100. The light distributions can be controlled depending on the environment, goals, etc. For example, with respect to a lighting system 100 that illuminates a crosswalk across a road or other path at an intersection between two or more roads, the lighting system 100 may generate a distribution of light having a wide shape and direction to illuminate a large portion of the intersection between the roads. Responsive to a person being able to enter the cross walk (e.g., by a traffic signal changing signals, by the person pressing a button, by a motion sensor detecting the person), the lighting system 100 can change the distribution of light. The distribution of light can be altered by reducing the size of the light distribution and/or changing the direction of the light distribution to focus on the cross walk instead of the entire intersection. As another example, the lighting system 100 may illuminate an entire office or other room during designated time periods of a day, but then switch to focusing the light distribution on a desk or other location in the room during other designated time periods of the day. The lighting system 100 may include a timer (e.g., a clock) in the power supply circuit 202 that can autonomously change the light distribution responsive to changes in time.

Figure 20:
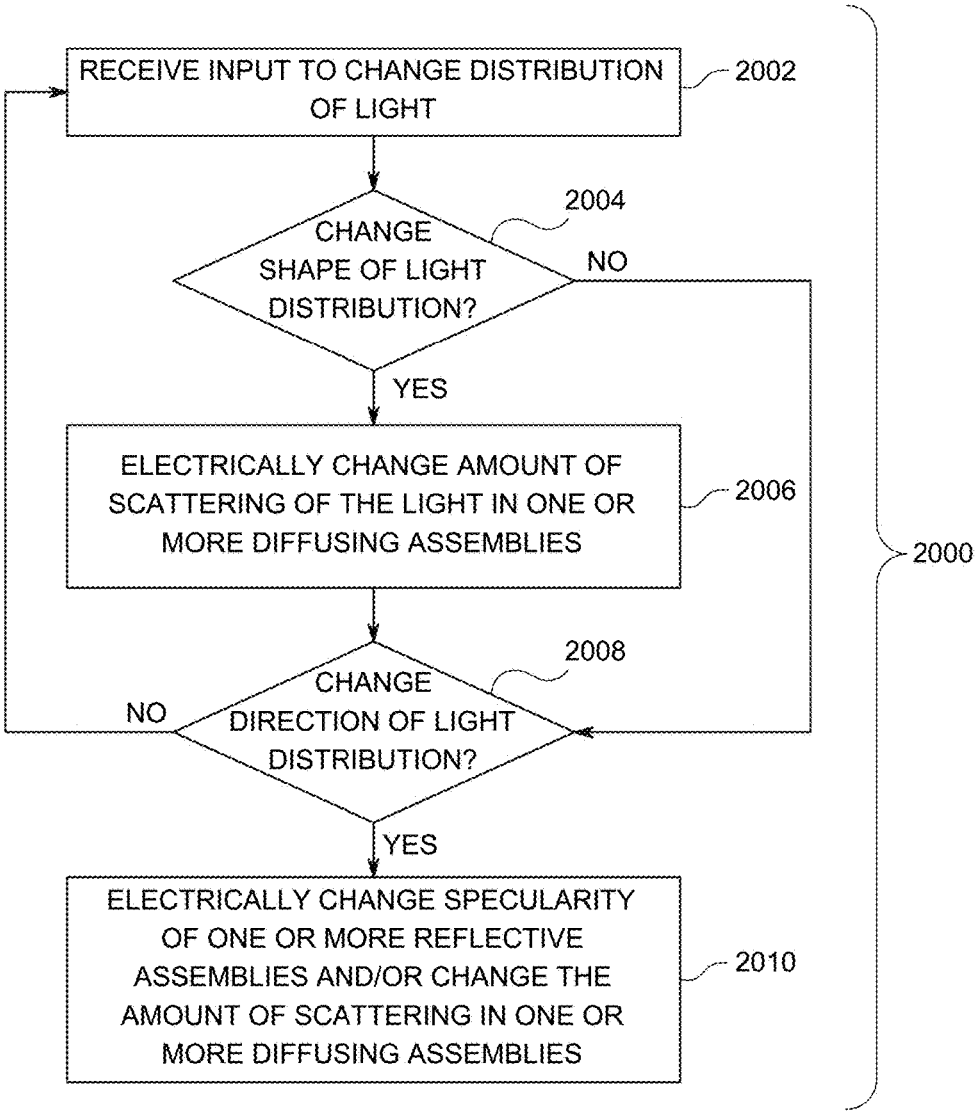
FIG. 20 illustrates a flowchart of one embodiment of a method for electrically controlling optics of a lighting system.

FIG. 20 illustrates a flowchart of one embodiment of a method 2000 for electrically controlling optics of a lighting system. The method 200 may be performed using the systems 1700 described herein. Alternatively, the method 2000 may be performed by one or more other lighting systems or other systems. The operations described in connection with the method 2000 may be used to generate a software program or algorithm for use in controlling one or more lighting systems.

At 2002, input is received to change the distribution of light emanating from a lighting system. This input may be received from the remote control device, by actuating a switch or other input device communicatively coupled with the lighting system, by a timer that autonomously changes the distribution of light, or from other input.

At 2004, a determination is made as to whether or not the change in the distribution of light is to change a shape of the light distribution. If the shape of light distillation is to change, then flow of the method 2000 may proceed toward 2006. If, on the other hand, the shape of the light distribution is not to change, then flow the method 2000 can proceed toward 2008.

At 2006, the amount of scattering of the light and one or more diffusing assemblies of the lighting system is electrically changed. As described above, by applying, removing, or changing electric potential applied across or between conductive layers on opposing sides of a liquid crystal layer, the amount of scattering of the light passing through the diffusing assembly may be controlled or otherwise changed. Changing the amount of scattering in the diffusing assembly can alter the shape of the light distribution in that increased scattering in the diffusing assembly can create a larger distribution or larger shape of the light while reduce scattering can reduce the size of the distribution of the light.

At 2008, a determination is made as to whether or not the direction of light distribution is to be changed. If the direction in which the light distribution is oriented is to be changed, then flow of the method 2000 can proceed toward 2010. If, on the other hand, the direction of light distribution is not to be changed, then flow of the method 2000 may return back toward 2002. For example, the method 2000 may proceed in a loop-wise manner back to 2002 to receive additional input to change distribution of the light. Alternatively, operation of the method 2000 may terminate if the direction of the light distribution is not to be changed at 2008.

At 2010, specularity of one or more reflective assemblies in the lighting system is electrically changed and/or the amount of scattering of the light in one or more diffusing assemblies is electrically changed. As described above, the specularity of the reflective assembly in a lighting system may be altered by changing the amount of scattering in a diffusing layer of the reflective assembly. Light that propagates through this diffusing layer before and/or after reflecting off a reflective surface in the reflective assembly. Applying, changing, or removing electric potential applied to conductive layers on opposite sides of the liquid crystal layer can change amount of scattering in the reflective assembly before and/or after reflection of the light off of the reflective layer and the reflective assembly. These changes in the scattering of the reflective assembly can alter the specularity of the reflective assembly. As a result, the direction in which light emanates from the lighting system may be changed. Optionally, changing the amount of scattering in the diffusing assembly may change the direction in which light emanates from the lighting system, as described above.

In one embodiment, a method (e.g., for actively controlling optics of a lighting system) includes generating light comprising a light distribution from a light source and changing the light distribution by changing an electric potential between conductive and light transmissive layers of a diffusing assembly that includes a liquid crystal layer disposed between the first and second conductive and light transmissive layers.

In one aspect, the light distribution comprises one or more of a shape of the generated light or a direction in which the generated light is oriented.

In one aspect, one or more of shape of the light that is generated or the direction in which the light that is generated is oriented, is changed.

In one aspect, changing the first electric potential changes a scattering of the generated light by the first liquid crystal layer.

In one aspect, the scattering of the generated light by the first liquid crystal layer is changed as a function of the first electric potential between the first and second conductive and light transmissive layers.

In one aspect, changing the light distribution includes changing a shape of the light by changing an amount of diffusion of the light with the first liquid crystal layer as a function of the first electric potential.

In one aspect, changing the light distribution includes changing a direction at which the light is oriented upon exiting the diffusing assembly by changing specularity of a reflective assembly that reflects at least a portion of the light toward the diffusing assembly.

In one aspect, the specularity of the reflective assembly is changed by changing a second electric potential between first and second conductive layers of the reflective assembly that includes a second liquid crystal layer between the first and second conductive layers.

In one aspect, the method also includes diverting at least some of an electric current that is supplied to the light source to power the light source away from the light source and to the first and second conductive and light transmissive layers of the diffusing assembly while the light source continues to generate the light.

In one aspect, the method also includes receiving a control signal from a remote control device to remotely change the light distribution.

In one aspect, changing the light distribution occurs without blocking one or more wavelengths of the light from passing through the diffusing assembly.

In one aspect, changing the light distribution occurs without mechanically moving the light source or the diffusing assembly.

In another embodiment, a system (e.g., a lighting system) includes a light source and a diffusing assembly. The light source is configured to generate a light defined by a light distribution. The diffusing assembly includes a liquid crystal layer disposed between conductive and light transmissive layers. The diffusing assembly is configured to change the light distribution responsive to a change in an electric potential between the conductive and light transmissive layers.

In one aspect, the change in the first electric potential changes a scattering of the light by the first liquid crystal layer.

In one aspect, the scattering is changed as a function of the first electric potential between the first and second conductive and light transmissive layers.

In one aspect, the diffusing assembly is configured to change a shape of the light by changing an amount of diffusion of the light with the first liquid crystal layer as a function of the first electric potential.

In one aspect, the system also includes a reflective assembly comprising a second liquid crystal layer disposed between first and second conductive layers. The reflective assembly is configured to change a direction at which the light distribution is oriented responsive to a change in specularity of the reflective assembly that reflects at least a portion of the light.

In one aspect, the reflective assembly is configured to change the specularity of the reflective assembly responsive to changing a second electric potential between first and second conductive layers of the reflective assembly.

In one aspect, the system also includes a power supply circuit configured to conduct electric current from a power source to the light source to power the light source for generation of the light. The power supply circuit also is configured to divert at least some of the electric current that is supplied to the light source to power the light source to the first and second conductive and light transmissive layers of the diffusing assembly while the light source continues to be powered by the power source and continues to generate the light.

In one aspect, the system also includes a communication assembly configured to receive a control signal from a remote control device to remotely change the first electric potential applied to the first and second conductive and light transmissive layers of the diffusing assembly.

In one aspect, the diffusing assembly is configured to change the light distribution without blocking one or more wavelengths of the light from passing through the diffusing assembly.

In one aspect, the diffusing assembly is configured to change the light distribution without mechanically moving the light source or the diffusing assembly.

In another embodiment, another system (e.g., a lighting system) includes a light source and a diffusing assembly and/or a reflective assembly. The light source is configured to generate a light defined by a light distribution. The diffusing assembly includes a first liquid crystal layer disposed between conductive and light transmissive layers. The diffusing assembly is configured to change the light distribution responsive to a change in an electric potential between the conductive and light transmissive layers. The reflective assembly includes a liquid crystal layer disposed between conductive layers. The reflective assembly is configured to change a direction at which the light distribution is oriented responsive to a change in specularity of the reflective assembly that reflects at least a portion of the light.

In one aspect, the system includes the diffusing assembly and the diffusing assembly is configured to change a shape of the light distribution by changing an amount of diffusion of the light with the first liquid crystal layer as the function of the first electric potential.

In one aspect, the system includes the reflective assembly and the reflective assembly is configured to change the specularity of the reflective assembly responsive to changing a second electric potential between first and second conductive layers of the reflective assembly.

The foregoing description of certain embodiments of the inventive subject matter will be better understood when read in conjunction with the appended drawings. The various embodiments are not limited to the arrangements and instrumentality shown in the drawings. The above description is illustrative and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Other embodiments may be apparent to one of ordinary skill in the art upon reviewing the above description. The scope of the inventive subject matter should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure. And, as used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a light source configured to generate a light defined by a light distribution;

an electro-active optical component comprising a diffusing assembly and a reflective assembly, wherein the diffusing assembly is configured to change the light distribution responsive to a change in a first electric potential applied across the diffusing assembly by an electronic control system, and wherein the reflective assembly comprises:

a liquid crystal layer;

a reflective layer disposed on one side of the liquid crystal layer and configured to reflect light entering the reflective assembly; and a conductive and light transmissive layer disposed on another side of the liquid crystal layer, wherein the another side is opposite to the one side.

2. The system in accordance with claim 1, wherein the diffusing assembly comprises a liquid crystal layer and the change in the first electric potential changes a scattering of the light by the liquid crystal layer.

3. The system in accordance with claim 2, wherein the diffusing assembly comprises conductive and light transmissive layers on opposite sides of the liquid crystal layer, and wherein the scattering is changed as a function of the first electric potential between the conductive and light transmissive layers.

4. The system in accordance with claim 2, wherein the diffusing assembly is configured to change a shape of the light by changing an amount of diffusion of the light with the liquid crystal layer of the diffusing assembly as a function of the first electric potential.

5. The system in accordance with claim 1, wherein the liquid crystal layer of the reflective assembly is disposed between conductive layers, and wherein the reflective assembly is configured to change a direction at which the light distribution is oriented responsive to a change in specularity of the reflective assembly that reflects at least a portion of the light.

6. The system in accordance with claim 5, wherein the reflective assembly is configured to change the specularity of the reflective assembly responsive to changing a second electric potential between the conductive layers of the reflective assembly.

7. The system in accordance with claim 1, further comprising a power supply circuit configured to conduct electric current from a power source to the light source to power the light source for generation of the light, wherein the power supply circuit is configured to divert at least some of the electric current that is supplied to the light source to power the light source to at least one of the diffusing assembly and the reflective assembly while the light source continues to be powered by the power source and continues to generate the light.

8. The system in accordance with claim 1, further comprising a communication assembly configured to receive a control signal from a remote control device to remotely change the first electric potential applied to the diffusing assembly.

9. The system in accordance with claim 1, wherein the diffusing assembly is configured to change the light distribution without blocking one or more wavelengths of the light from passing through the diffusing assembly.

10. The system in accordance with claim 1, wherein the diffusing assembly is configured to change the light distribution without mechanically moving the light source or the diffusing assembly.

11. A system comprising:

a light source configured to generate a light defined by a light distribution;

an electro-active optical component comprising a diffusing assembly and a reflective assembly, wherein the diffusing assembly is configured to change the light distribution responsive to a change in a first electric potential applied to the diffusing assembly, wherein the reflective assembly is configured to change a direction at which the light distribution is oriented responsive to a change in specularity of the reflective assembly, and wherein the reflective assembly comprises:

a liquid crystal layer;

a reflective layer disposed on one side of the liquid crystal layer and configured to reflect light entering the reflective assembly; and a conductive and light transmissive layer disposed on another side of the liquid crystal layer, wherein the another side is opposite to the one side.

12. The system in accordance with claim 11, wherein the diffusing assembly is configured to change a shape of the light distribution by changing an amount of diffusion of the light with as a function of the first electric potential.

13. The system in accordance with claim 11, wherein the reflective assembly is configured to change the specularity of the reflective assembly responsive to changing a second electric potential applied to the reflective assembly.

14. The system in accordance with claim 11, wherein the reflective layer comprises at least one of a metallized coating and a metallic layer.

15. The system in accordance with claim 11, wherein the reflective assembly is coupled to the diffusing assembly at a determined angle.

16. The system in accordance with claim 11, wherein the reflective assembly has a frustoconical shape disposed around the light source.

* * * * *